United States Patent [19]

Henn et al.

[11] 4,409,935

[45] Oct. 18, 1983

[54] MECHANICAL VALVE CLEARANCE COMPENSATOR FOR INTERNAL COMBUSTION ENGINES

[75] Inventors: Werner Henn, Tübingen; Reiner Bachschmid, Kernen-Rommelshuasen; Karl Zeilinger, Berglen-Hösslinswart, all of Fed. Rep. of Germany

[73] Assignee: Daimler-Benz AG, Fed. Rep. of Germany

[21] Appl. No.: 200,465

[22] Filed: Oct. 24, 1980

[30] Foreign Application Priority Data

Oct. 26, 1979 [DE] Fed. Rep. of Germany ..... 2943246

[51] Int. Cl.[3] ..... F01L 1/22

[52] U.S. Cl. ..... 123/90.53; 123/90.6

[58] Field of Search ..... 123/90.48, 90.52, 90.53, 123/90.54, 90.6; 74/569

[56] References Cited

U.S. PATENT DOCUMENTS

| | | | |
|---|---|---|---|
| 1,571,175 | 1/1926 | Bazzoni | 123/90.53 |
| 1,609,711 | 12/1926 | Goodwin | 123/90.53 |
| 1,663,345 | 3/1928 | Lievre | 123/90.53 |
| 2,050,766 | 8/1936 | Russel | 123/90.54 |
| 2,158,730 | 5/1939 | Russel | 123/90.53 |
| 2,672,132 | 3/1954 | Randol | 123/90.53 |

FOREIGN PATENT DOCUMENTS

| | | | |
|---|---|---|---|
| 1451942 | 4/1970 | Fed. Rep. of Germany | 123/90.52 |

*Primary Examiner*—Craig R. Feinberg
*Assistant Examiner*—W. R. Wolfe
*Attorney, Agent, or Firm*—Craig & Burns

[57] ABSTRACT

A mechanical valve clearance compensator for internal combustion engines with cup tappet operation. A wedge provided with a wedge-shaped surface is supported in the cup tappet to be displaceable at right angles to a travel direction of the cup tappet. The wedge is under a constant action of a compression spring which acts in a direction toward clearance compensation and is intermittently acted upon in an opposite direction by an operating cam fixedly connected with the cam shaft. The operating cam is fashioned as a radial cam and acts upon a pin longitudinally displaceably guided in the cup tappet. The pin, in turn, is supported on a sliding surface of a wedge, with the sliding surface having a greater inclination than an inclination of the wedge-shaped surface.

13 Claims, 8 Drawing Figures

MECHANICAL VALVE CLEARANCE COMPENSATOR FOR INTERNAL COMBUSTION ENGINES

The present invention relates to a clearance compensator and, more particularly, to a mechanical valve clearance compensator for internal combustion engines with a cup tappet operation, wherein a wedge, provided with a wedge-shaped surface is displaceably arranged in the cup tappet and is movable at right angles to a direction of travel of the cup tappet, which wedge is under a constant action of a compression spring effective in a direction toward a clearance compensation and under an intermittent action in an opposite direction of an operating cam fixedly joined to the camshaft.

A valve clearance compensator of the aforementioned type is proposed in, for example, German Patent Application No. P 29 32 504.0, wherein a disk is arranged on the camshaft with an axially acting cam for an operation of the wedge, which wedge is adapted to be horizontally displaced. A disadvantage of this proposed clearance compensator resides in the fact that the operation of the wedge requires an amount of space which exceeds, with respect to the height of the wedge, the control cams of the camshaft. A further disadvantage resides in the fact that there is not an inconsiderable increase in the weight of the camshaft as well as in the requirement for an expensive manufacturing process in order to machine the axial cam at the disk.

The aim underlying the present invention essentially resides in providing a compact valve clearance compensator which requires less space and which enables an overall reduction in the total weight thereof.

In accordance with advantageous features of the present invention, an operating cam is fashioned as a radial cam, with the cam acting on a pin longitudinally displaceably guided in the cup tappet. The pin is supported, in turn, on a sliding surface of a wedge which is of a greater inclination that the wedge-shaped surface.

By virtue of the above-noted features of the present invention, the operating cam on the camshaft projects neither laterally beyond the cup tappet nor beyond a circle described by the control cam of the camshaft.

In accordance with further advantageous features of the present invention, the operating cam is arranged in each control cam of the camshaft with the pin being centrally supported in the cup tappet. An advantage of this arrangement resides in the fact that it is unnecessary to secure the cup tappet against rotation.

In order to equalize dimensional inaccuracies in the wedge, the cup tappet, and the valve, thereby ensuring a flush contacting of the contact surface of the tappet, valve and wedge, the wedge is of a bipartite construction and includes a sliding member and a pressure member. The pressure member is mounted in circular recess of the sliding member so as to be pivotable at right angles to an axis of the tappet and in a travel direction of the sliding member, wherein the oblique sliding surface is arranged in the pressure member, and the wedge-shaped surface of the wedge is constituted merely by the pressure member.

In order to improve a guidance of the pin executing the necessary stroke movements, and in order to obtain a better horizontal displacement of the wedge, in accordance with further features of the present invention, the sliding surface may be formed by a guide groove arranged in the pressure member. The sliding surface and/or the guide groove of the pressure member may form an angle of 45° with respect to a travel direction of the wedge.

In order to ensure that the cup tappet operates with a minimum of wear and tear, in accordance with the present invention, the halves of the control cam lying beside the operating cam are fashioned so as to be of unequal widths.

In accordance with further advantageous features of the present invention, the sliding member may be provided with strip-shaped projections which extend axially along its longitudinal sides, with the projections being slidingly arranged in the guide grooves of the cup tappet. By virtue of this arrangement, the complete wedge, including the compression spring, may be mounted beforehand in the cup tappet.

Accordingly, it is an object of the present invention to provide a mechanical valve clearance compensator for internal combustion engines which avoids, by simple means, shortcomings and disadvantages encountered in the prior art.

Another object of the present invention resides in providing a mechanical valve clearance compensator for internal combustion engines which is simple in construction and therefore relatively inexpensive to manufacture.

A further object of the present invention resides in providing a mechanical valve clearance compensator which requires a minimum of space.

A still further object of the present invention resides in providing a mechanical valve clearance compensator for internal combustion engines which functions reliably under all operating conditions.

These and other objects, features, and advantages of the present invention will become more apparent from the following description when taken in connection with the accompanying drawings which show, for the purposes of illustration only, several embodiments in accordance with the present invention, and wherein.

Figure 1:
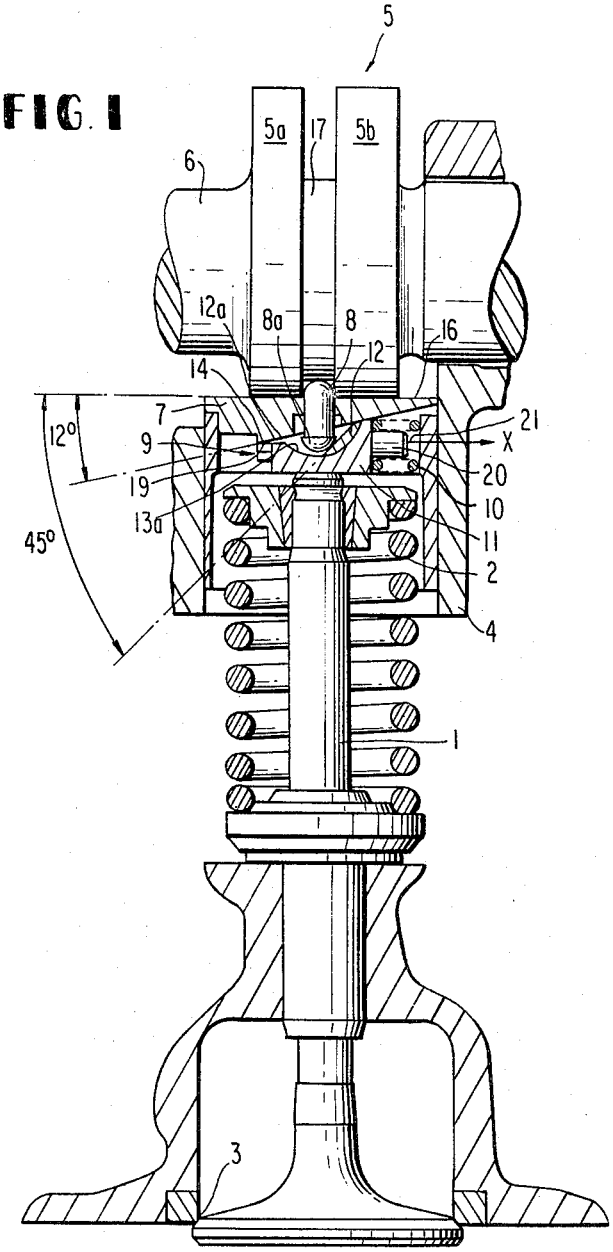
FIG. 1 is a cross-sectional view of a valve clearance compensator in accordance with the present invention employing a bipartite wedge with a cup tappet being directly operated by a cam of a camshaft of an internal combustion engine.

Referring now to the drawings wherein like reference numerals are used throughout the various views to designate like parts and, more particularly, to FIG. 1, according to this figure, a valve 1 of an internal combustion engine is urged, in a conventional manner, onto a valve seat 3 provided in a cylinder head 4 by means of a valve spring 2. The valve 1 is operated by an operating cam generally designated by the reference numeral 5 of an overhead camshaft 6 through a cup tappet 7.

A valve clearance compensator is disposed in the cup tappet 7, with the compensator including a pin 8 arranged coaxially and longitudinally displaceably with respect to the valve 1 and the cup tappet 7, a wedge generally designated by the reference numeral 9, lying between the cup tappet 7 and the valve 1, and a compression spring 10.

The wedge 9 is of a bipartite construction and includes a sliding member 11 and a pressure member 12. The sliding member 11 is slidingly arranged on a stem end of the valve 1 and, as shown most clearly in FIG. 4, the sliding member 11 includes a recess 13 having, as shown most clearly in FIG. 1, a bearing base surface 13*a* on which the pressure member 12 is pivotably mounted. The pressure member 12 is adapted to the shape of the bearing base surface 13*a* and is dimensioned in size so that it projects in total from the recess 13 of the sliding member 11 and contacts, with a planar surface 12*a*, an obliquely extending bottom underside surface 14 of the cup tappet 7. The planar surface 12*a* simultaneously forms the wedge-shaped surface of the wedge 9.

Figure 5:
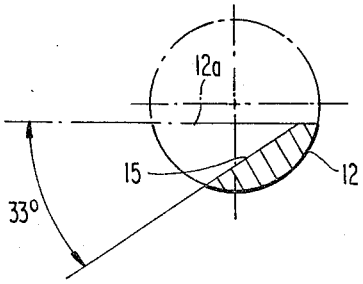
FIG. 5 is a cross-sectional view of a pressure member of the valve clearance compensator in accordance with the present invention.
Figure 6:
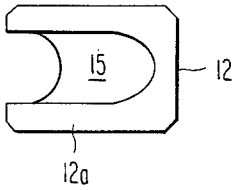
FIG. 6 is a top view of the pressure member of FIG. 5.

As shown in the enlarged detailed views of FIGS. 5 and 6, the pressure member 12 is provided with an oblique guide groove 15 (FIG. 5) which serves to accommodate the pin 8, with the guide groove 15 and wedge-shaped surface 12*a* forming an angle of about 33°.

Assuming that the bottom underside surface 14 and the bottom of the upper surface 16 of the cup tappet 7 form an angle of, for example, 12°, and the guide groove 15 and wedge-shaped surface 12*a* form an angle of 33°, an angle of 45° results between the guide groove 15 and the displacement direction designated X of the wedge 9, when the pressure member 12 is installed in the sliding member 11.

The pin 8 slides in the oblique guide groove 15 with a hemispherical sliding head 8*a*.

Figure 2:
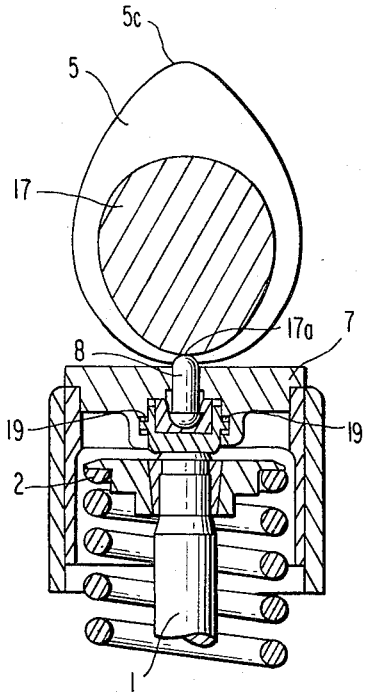
FIG. 2 is a lateral cross-sectional view of the valve clearance compensator of FIG. 1.

As shown in FIGS. 1 and 2, a radially extending operating cam 17 is provided for operating the pin 8. The cam 17 is integrally formed with the control cam 5 so as to result in two control cam halves 5*a*, 5*b*, with a control cam half 5*b* having a broader width. The differing widths of the control cam halves 5*a*, 5*b* of the control cam 5 effect, during an operation of the internal combustion engine, an intermittent rotation of the cup tappet 7, thereby resulting in minimizing the wear and tear on the cup tappet.

As shown most clearly in FIG. 2, the control cam 5 and operating cam 17 are related in such a manner that the cam tips 5*c* of the control cam 5 and 17*a* of the operating cam 17 are in mutual opposition.

Figure 3:
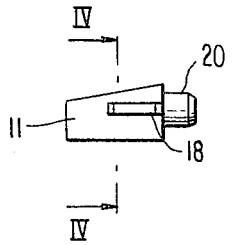
FIG. 3 is an elevational view of a sliding member of the valve clearance compensator of the present invention provided with strip-like projections.
Figure 4:
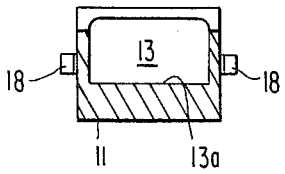
FIG. 4 is a cross-sectional view of the sliding member taken along the line IV—IV of FIG. 3.

As shown in FIGS. 3 and 4, the sliding member 11 is provided with strip-shaped projections 18. The projections 18 extend only over one-half of the sliding member 11 (FIG. 3). The strip-shaped projections 18 are adapted to slide in guide grooves 19 (FIGS. 1 and 2) which are worked or formed into the cup tappet 7. A peg or pin 20 is provided at an end face of the sliding member 11 and, as shown in FIG. 1, the compression spring 10 rests on an inner wall 21 of the cup tappet 7 and is supported by the peg or pin 20.

Figure 7:
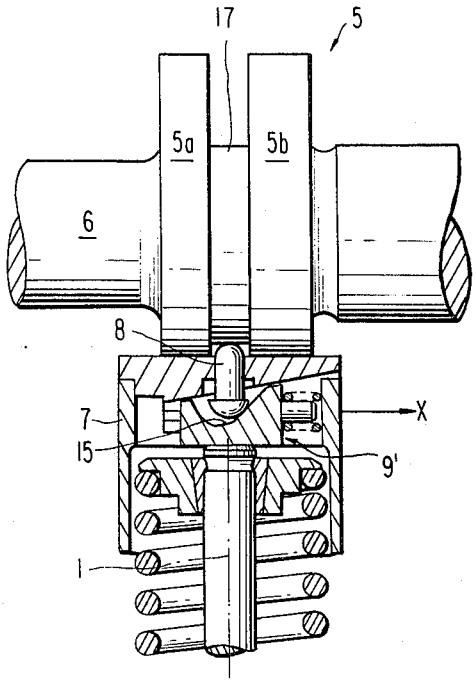
FIG. 7 is a partial cross-sectional view of another embodiment of a valve clearance compensator in accordance with the present invention having a one-piece wedge.
Figure 8:
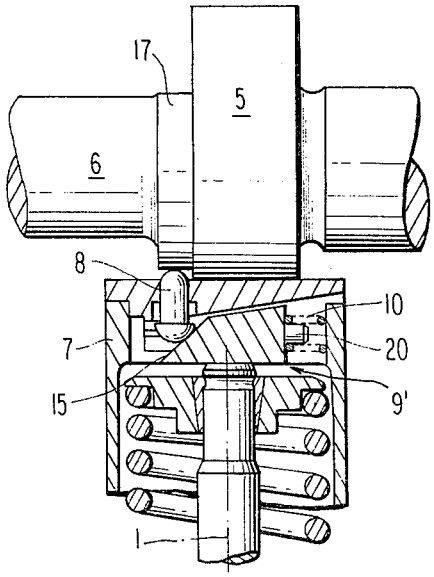
FIG. 8 is a cross-sectional view of a further embodiment of a valve clearance compensator in accordance with the present invention having a one-piece wedge.

While the constructions described hereinabove in connection with FIGS. 1–6 provide for a valve clearance compensator with a wedge 9 formed by a sliding member 11 and a pressure member 12, as shown in FIGS. 7 and 8, it is also possible to provide a one-piece wedge generally designated by the reference numeral 9'. In the construction of FIG. 7, the operating cam 17 is also arranged between the two control cam halves 5*a*, 5*b* and the pin 8 is likewise arranged centrally in the cup tappet. In contrast to the arrangement of FIG. 7, in the valve clearance compensator of FIG. 8, the operating cam 17 lies beside the control cam 5 with the pin 8, cooperating with the control cam 5, being eccentrically supported in the cup tappet 7. In this latter construction, a rotational securing must be provided for the cup tappet 7.

The valve clearance compensator of FIGS. 1–6 operates in the following manner.

The wedge 9 acccommodated in the cup tappet 7 effects, in cooperation with the compression spring 10, a clearance-free connection between the control cam 5 and the valve 1 during a duration of an opening time of the valve 1. By means of the pin 8, operated by the operating cam 17, the sliding member 11 is shifted axially against the force of the compression spring 10 by way of the pressure member 12 in the closed position of the valve 1 over a partial section of the closing period wherein the valve drive parts are relieved. In detail, the cycle of movement is such that the stroke of the operating cam 17 is transmitted to the pin 8 which, in turn, slides downwardly along the inclined guide groove 15 of the pivotally supported pressure member 12 and, during this step, displaces the pressure member 12 together with the sliding member 11 against the compression spring in the direction X, whereby a clearance is produced between the control cam 5 and the valve 1.

In good time, prior to an opening of the valve 1, the operating cam 17 again releases the wedge 9 formed by the pressure member 12 and the sliding member 11, with the compression spring 10 urging the wedge 9 into a position eliminating the clearance between the control cam 5 and the valve 1.

As can readily be appreciated, the wedge 9' of the valve clearance compensators of FIGS. 7 and 8 operate in essentially the same manner as described hereinabove, with the stroke of the operating cam 17 being transmitted to the pin 8 which slides down along the inclined guide surface 15 so as to result in a displacement of the wedge 9' in a direction X against the action of the compression spring 10 so as to provide the clearance between the control cam 5 and the valve 1. Prior to opening of the valve 1, the operating cam releases the wedge 9' whereby the compression spring urges the wedge 9' into a position eliminating the clearance between the control cam 5 and the valve 1.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A mechanical valve clearance compensator arrangement for an internal combustion engine, which engine is provided with a camshaft means cooperable with a cup tappet means for effecting operation of engine valves, the arrangement comprising a wedge means supported in the cup tappet means for displacement in a direction at right angles to a travel direction of the cup tappet means, the wedge means including an inclined wedge surface, means for constantly urging the wedge means in a clearance-compensation direction, and means for intermittently acting upon the wedge means for urging the wedge means in a direction opposite the clearance-compensation direction, the means for intermittently acting upon the wedge means includes a radial operating cam fixedly connected to the camshaft means, a pin means longitudinally displaceably guided in the cup tappet means and interposed between the operating cam and the wedge means for transmitting motion of the operating cam to the wedge means, and in that the wedge means includes a sliding surface means for supporting the pin means, the sliding surface means has an inclination which is greater than the inclination of the wedge surface of the wedge means, characterized in that the wedge means includes a sliding member and a pressure member, the sliding member includes a circular recess for pivotably mounting the pressure member at a right angle to a central axis of the cup tappet means and in a direction of travel of the sliding member, the sliding surface means is arranged in the pressure member and the wedge surface of the wedge means is formed by the pressure member.

2. A mechanical valve clearance compensator arrangement for an internal combustion engine, which engine is provided with a camshaft means cooperable with a cup tappet means for effecting operation of engine valves, the arrangement comprising a wedge means supported in the cup tappet means for displacement in a direction at right angles to a travel direction of the cup tappet means, the wedge means including an inclined wedge surface, means for constantly urging the wedge means in a clearance-compensation direction, and means for intermittently acting upon the wedge means for urging the wedge means in a direction opposite the clearance-compensation direction, the means for intermittently acting upon the wedge means includes a radial operating cam fixedly connected to the camshaft means, a pin means longitudinally displaceably guided in the cup tappet means and interposed between the operating cam and the wedge means for transmitting motion of the operating cam to the wedge means, and in that the wedge means includes a sliding surface means for supporting the pin means, the sliding surface means has an inclination which is greater than the inclination of the wedge surface of the wedge means, the camshaft means includes a plurality of control cams, the operating cam is arranged in each control cam, and in that the pin means is centrally disposed in the cup tappet means, the sliding surface means is formed by a guide groove provided in the wedge means, and characterized in that the wedge means is provided with strip-shaped axially extending projections on each longitudinal side thereof, and in that guide groove means are provided in the cup tappet means for slidably accommodating the respective projections.

3. A mechanical valve clearance compensator arrangement for an internal combustion engine, which engine is provided with a camshaft means cooperable with a cup tappet means for effecting operation of engine valve, the arrangement comprising a wedge means supported in the cup tappet means for displacement in a direction at right angles to a travel direction of the cup tappet means, the wedge means including an inclined wedge surface, means for constantly urging the wedge means in a clearance-compensation direction, and means for intermittently acting upon the wedge means for urging the wedge means in a direction opposite the clearance-compensation direction, characterized in that the means for intermittently acting upon the wedge means includes a radial operating cam fixedly connected to the camshaft means, a pin means longitudinally displaceably guided in the cup tappet means and interposed between the operating cam and the wedge means for transmitting motion of the operating cam to the wedge means, the wedge means comprises a sliding surface means for supporting the pin means, a pressure member means pivotally mounted within a circularly surfaced groove within the sliding surface means for engaging the pin means, the sliding surface of the sliding surface means has an inclination which is greater than the inclination of the wedge surface of the wedge means.

4. A valve clearance compensator according to claim 3, characterized in that the camshaft means includes a plurality of control cams, the operating cam is arranged in each control cam, and in that the pin means is centrally disposed in the cup tappet means.

5. A mechanical valve clearance compensator arrangement for an internal combustion engine, which engine is provided with a camshaft means cooperable with a cup tappet means for effecting operation of engine valves, the arrangement comprising a wedge means supported in the cup tappet means for displacement in a direction at right angles to a travel direction of the cup tappet means, the wedge means including an inclined wedge surface, means for constantly urging the wedge means in a clearance-compensation direction, and means for intermittently acting upon the wedge means for urging the wedge means in a direction opposite the clearance-compensation direction, the means for intermittently acting upon the wedge means includes a radial operating cam fixedly connected to the camshaft means, a pin means longitudinally displaceably guided in the cup tappet means and interposed between the operating cam and the wedge means for transmitting motion of the operating cam to the wedge means, and in that the wedge means includes a sliding surface means for supporting the pin means, the sliding surface means has an inclination which is greater than the inclination of the wedge surface of the wedge means, the camshaft means includes a plurality of control cams, the operating cam is arranged in each control cam, and in that the pin means is centrally disposed in the cup tappet means, the sliding surface means is formed by a guide groove provided in the wedge means, and characterized in that the operating cam divides the respective control cams into two control cam portions, and in that the control cam portions are of unequal widths.

6. A valve clearance compensator according to claim 5, characterized in that the wedge means is provided with strip-shaped axially extending projections on each longitudinal side thereof, and in that guide groove means are provided in the cup tappet means for slidably accommodating the respective projections.

7. A valve clearance compensator according to claim 6, characterized in that the means for constantly urging the wedge means is a compression spring, and in that a peg means is provided on an end face of the sliding member for supporting the compression spring.

8. A mechanical valve clearance compensator arrangement for an internal combustion engine, which engine is provided with a camshaft means cooperable with a cup tappet means for effecting operation of engine valves, the arrangement comprising a wedge means supported in the cup tappet means for displacement in a direction at right angles to a travel direction of the cup tappet means, the wedge means including an inclined wedge surface, means for constantly urging the wedge means in a clearance-compensation direction, and means for intermittently acting upon the wedge means for urging the wedge means in a direction opposite the clearance-compensation direction the means for intermittently acting upon the wedge means includes a radial operating cam fixedly connected to the camshaft means, a pin means longitudinally displaceably guided in the cup tappet means and interposed between the operating cam and the wedge means for transmitting motion of the operating cam to the wedge means, and in that the wedge means includes a sliding surface means for supporting the pin means, the sliding surface means has an inclination which is greater than the inclination of the wedge surface of the wedge means, the camshaft means includes a plurality of control cams, the operating cam is arranged in each control cam, and in that the pin means is centrally disposed in the cup tappet means, and characterized in that the wedge means includes a sliding member and a pressure member, the sliding member includes a circular recess for pivotably mounting the pressure member at a right angle to a central axis of the cup tappet means and in a direction of travel of the sliding member, the sliding surface means is arranged in the pressure member and the wedge surface of the wedge means is formed by the pressure member.

9. A valve clearance compensator according to claim 8, characterized in that the sliding surface means is formed by a guide groove arranged in the pressure member.

10. A valve clearance compensator according to claim 9, characterized in that the guide groove subtends an angle of about 45° with respect to a plane extending in a direction of travel of the wedge means.

11. A valve clearance compensator according to claim 10, characterized in that the operating cam divides the respective control cams into two control cam portions, and in that the control cam portions are of unequal widths.

12. A valve clearance compensator according to claim 11, characterized in that the sliding member is provided with strip-shaped, axially extending projections on each longitudinal side thereof, and in that the guide groove means are provided in the cup tappet means for slidably accommodating the respective projections.

13. A valve clearance compensator according to claim 12, characterized in that the means for constantly urging the wedge means is a compression spring, and in that a peg means is provided in an end face of the sliding member for supporting the compression spring.

* * * * *